US011795020B2

(12) United States Patent
Konukoglu et al.

(10) Patent No.: US 11,795,020 B2
(45) Date of Patent: Oct. 24, 2023

(54) METHOD OF PRODUCING A FABRIC ROLL AND ROLL THUS MADE

(71) Applicant: Sanko Tekstil Isletmeleri San. Ve Tic. A.S., Inegol-Bursa (TR)

(72) Inventors: Fatih Konukoglu, Inegol-Bursa (TR); Melik Parlakbolat, Inegol-Bursa (TR); Kamuran Cebe, Inegol-Bursa (TR); Ismail Aka, Inegol-Bursa (TR); Kadir Tunçay Iyidogan, Inegol-Bursa (TR); Mahmut Ozdemir, Inegol-Bursa (TR); Ertug Erkus, Inegol-Bursa (TR)

(73) Assignee: SANKO TEKSTIL ISLETMELERI SAN. VE TIC. A.S., Inegol-Bursa (TR)

( * ) Notice: Subject to any disclaimer, the term of this patent is extended or adjusted under 35 U.S.C. 154(b) by 414 days.

(21) Appl. No.: 16/567,089

(22) Filed: Sep. 11, 2019

(65) Prior Publication Data

US 2020/0079609 A1 Mar. 12, 2020

(30) Foreign Application Priority Data

Sep. 11, 2018 (EP) ..... 18193731

(51) Int. Cl.
*B65H 18/14* (2006.01)
*B65H 75/18* (2006.01)

(52) U.S. Cl.
CPC ..... *B65H 18/14* (2013.01); *B65H 75/18* (2013.01)

(58) Field of Classification Search
CPC ..... B65H 18/14; B65H 18/028; B65H 18/28; B65H 75/10; B65H 75/18; B65H 75/28; B65H 2301/41828; B65H 2301/41829
See application file for complete search history.

(56) References Cited

U.S. PATENT DOCUMENTS 4,208,019 A * 6/1980 Dusenbery ..... B65H 19/2284 242/527.2
5,054,708 A 10/1991 Wiggers
5,281,386 A 1/1994 Weinert
6,260,787 B1 * 7/2001 Michel ..... B65H 19/30 242/530.4
7,438,254 B2 * 10/2008 Oettershagen ..... B65H 75/10 242/596.7
8,708,267 B2 * 4/2014 Morgan ..... B65H 75/22 242/160.4
9,272,870 B2 * 3/2016 Stanton ..... B65H 75/406
(Continued)

FOREIGN PATENT DOCUMENTS

DE 297 07 767 8/1998
DE 199 46 272 3/2001
(Continued)

OTHER PUBLICATIONS

International search report and written opinion dated Dec. 17, 2019 for corresponding International application No. PCT/EP2019/074272.

(Continued)

*Primary Examiner* — Sang K Kim

(57) ABSTRACT

A fabric roll is produced by winding a fabric (4) around at least two reels, that are coaxially aligned, spaced from each other, and have a total length (L) that is less than the width (Wr) of said fabric roll (11).

6 Claims, 5 Drawing Sheets

(56) References Cited

U.S. PATENT DOCUMENTS

| | | | | |
|---|---|---|---|---|
| 2003/0057314 | A1* | 3/2003 | White | B65H 19/305 242/533.7 |
| 2005/0098676 | A1* | 5/2005 | Vuoristo | B65H 19/305 242/530.1 |
| 2007/0262187 | A1* | 11/2007 | Malecot | B65H 19/2246 242/525.6 |
| 2011/0017861 | A1* | 1/2011 | Nakanishi | B65H 75/22 242/533 |
| 2013/0341450 | A1 | 12/2013 | Denis et al. | |

FOREIGN PATENT DOCUMENTS

| | | |
|---|---|---|
| EP | 1295832 | 3/2003 |
| EP | 1310447 | 5/2003 |
| EP | 2123584 | 11/2009 |
| GB | 2 028 772 | 3/1980 |

OTHER PUBLICATIONS

European Search Report issued by the EPO dated Feb. 4, 2020 for corresponding EP application No. 19196810.

* cited by examiner

METHOD OF PRODUCING A FABRIC ROLL AND ROLL THUS MADE

This non-provisional application claims priority to and the benefit of European Application No. EP18193731.9 filed on 11 Sep. 2018, the content of which is incorporated herein by reference in its entirety.

The present invention relates to a method of producing a fabric roll and to a fabric roll thus obtained. In greater detail, the invention relates to a method of winding fabric on a reel in a fabric production step.

Fabric is usually stored and transported as rolls; in the rolls, fabric is wound, or wrapped, around a reel. Normally, the reel is chosen so as to extend from one side of the fabric to the opposite side, in order to support the fabric roll. There are a variety of lengths of wrapping reels for fabric packaging process. The lengths of reels can change between 700 mm and 2200 mm according to the width of the fabric web to be wound on the reel.

Thus, in known fabric packaging steps, different lengths (sizes) of fabric rolls are produced. For every size of fabric roll a suitable reel is needed: this results in the necessity of having different reel, having different lengths, available to be used according to the width of the fabric web. A further problem of known methods is that the reels are normally made of cardboard or plastic and use of a reel results in adding the weight of the reel to the weight of the fabric roll. A further problem is that the wrapping reels can not be reused after the fabric has been unwound from the reel; therefore used reels become industrial waste or, if possible, they are sent for recycling of their material (e.g. to a plastic recycling process).

There is therefore the necessity of solving the above mentioned problems and providing a new method of producing a fabric roll.

It is an aim of the present invention to solve the above problems. Such an aim is reached by means of the method of producing a fabric roll, according to claim 1. Namely, the invention method provides method of producing a fabric roll, in which a web of fabric is wound (i.e. wrapped) around a reel to provide a roll, characterized in that the fabric is wound around at least two reels, said reels being coaxially aligned and being spaced from each other, the at least two reels having a total length that is less than the width of said fabric roll. A further object of the invention is a fabric roll according to claim 8; namely the fabric roll is characterized by including at least two reels that are coaxial, or substantially coaxially aligned, and that are spaced from each other. As mentioned, the plurality of (at least two) reels replaces the single reel of the prior art in a fabric roll. The amount of reels suitable for the invention is at least two and depends also on the width of the roll, i.e. on the length of the reel that would be used according to prior art (said length would correspond to the width of the fabric, or width of the roll.

In an embodiment, two reels are positioned at least at the ends of the roll width to support the edges of said fabric roll and avoid the fabric being without support at the edges of the roll, which can easily damage the fabric. In greater detail, the external edge of the reel may be offset from the edge of the roll of fabric by a value that may be of about 10 cm i.e. the edge, or extremity, of the reel may be spaced about 10 cm from the edge of the fabric roll; the offset may be towards the outside, i.e. the reel protrudes from the roll, or towards inside the roll, i.e. the reel's external edge is housed inside the roll. In an embodiment, an additional reel is centrally positioned with respect to the said width of the fabric roll; in this embodiment, there will be two reels at the extremity of the roll axis (i.e. at the edges) and one further reel between the above mentioned edge reels, preferably located centrally to the axis of the roll of fabric.

In general, when there are n reels (e.g. three reels, n=1–3) the sum of the lengths $L_1$ to $L_n$ of each of the n reels (e.g. $L_1+L_2+L_3$), is less than the transversal length, i.e. less than the width W, of the roll of fabric. The above relationship may be summarized with the following equation: $\Sigma_{i=1}^{n}L_i<Wr$, wherein $L_i$ is the length of each of said reels and the reels are n, i.e. the sum of the lengths $L_1$ to $L_n$ of the n reels ($\Sigma_{i=1}^{n}L_i$) is less than the width (Wr) of the fabric roll. In an embodiment, the sum of the lengths of the reels ($\Sigma_{i=1}^{n}L_i$) is at least 13% of the width of the roll Wr, preferably at least 40% of the width of the roll Wr. In preferred embodiments, the maximum value of the sum ($\Sigma_{i=1}^{n}L_i$) of the lengths $L_1$–$L_n$ is 91%, preferably 60% of the width Wr of the fabric, i.e. in general the relationship is $0.13Wr\leq\Sigma_{i=1}^{n}L_i\leq0.91Wr$.

In an embodiment, the method includes a starting step wherein the edge of the fabric is attached to said at least two reels, in a way to avoid creases and folds on the fabric; the fabric edge is preferably tensioned over its width so as to remain attached to the reels and avoid deformations in the first windings of the fabric on the reels. In a similar embodiment, the starting step includes manually wrapping the fabric, preferably tensioned, around the reels to avoid forming of creases and folds.

Suitable materials for the reels are traditional materials used for said purpose. Preferably, reels are made of cardboard (natural fibers such as cellulosic(s)) and man-made or synthetic materials (such as PP, PE, PET, ABS, Rubber, PU etc.). The material is selected with respect to its specific density, preferring light materials. To make the reel lighter, the surface of the reel can have a porous structure, i.e. a plurality of holes, or a plurality of areas (i.e. portions of the reel) having a reduced thickness with respect to the remaining parts of the reel, may be present on the reel. In embodiments, the total area of the holes or of the reduced thickness portions in the reel surface is 40% to 80% of the area of the surface of the reel, preferably at least 60%. But the ratio can be between 0%-90%.

Preferably, the wrapping reels have at least one of the following features: internal diameters of reels are between 40 and 50 mm; external diameters of reels are between 45 and 57 mm. A preferred range for the thickness of reels is 3-4 mm. On the average, the linear weight of an reel is 3 grams per cm (3 grams/cm).

To provide a quality fabric roll, short reels must be aligned and during wrapping the reels must have the same circular movement with fabric roll. If not, quality defects occur on the surface of fabric roll. To provide a smooth wrapping, a wrapping equipment is used when positioning short reels. There are several commercially available that could be used for the present invention; in the following a preferred equipment and method are disclosed and are claimed in claims 8 to 10.

The number of reels to be used depends on the width of the fabric. The invention provides for a minimum of two reels, which is suitable e.g. for a fabric having width of e.g. 700 mm. Larger fabrics, such as e.g. a fabric having width of 2200 mm, may use three or four reels; thus, in an embodiment, the number of reels used is in the range of 2 to 4. As previously mentioned, the invention provides for the reels being spaced from each other, i.e. two adjacent reels are spaced by a distance. The distance between two adjacent reels depends on the width Wr of the fabric and on the number n of reels and on their length $L_i$. For example, in a fabric wherein the fabric width Wr is 1000 mm, the reel length is 200 mm, 2 reels are preferably used; the reels are located at the edges of the roll±10 cm. In this embodiment the gap, i.e. the distance between two adjacent reels, is 1000−(200+200)=600 mm; the possible offset of the reels edges with respect to the sides of the fabric is ±20 cm to be added or subtracted from the said distance. In an embodiment where the fabric roll width Wr is 2200 mm and three reels of 200 mm are used, the total gap is 2200−(200×3)=1600 mm and the distance between adjacent reels is 1600/2=800 mm.

The invention provides several advantages over the prior art. A first advantage is that it is possible to have a reduced number of lengths for the reels of the invention, because two or more reels can be used, according to the width of the fabric web to be rolled on the reels. This reduction in number of types of reels results in a dramatic reduction of the inventory costs of stocking wrapping reels for fabric rolls of different widths. Additionally, the weight of the fabric rolls is less, because ther reels are shorter; costs of transportation of packaged fabric rolls can thus be decreased as well. Finally, shorter reels result in less amount of waste hence sustainability is provided without changing the quality of packaging process.

The invention will now be further illustrated with reference to the attached schematic drawings, where:

Figure 1:
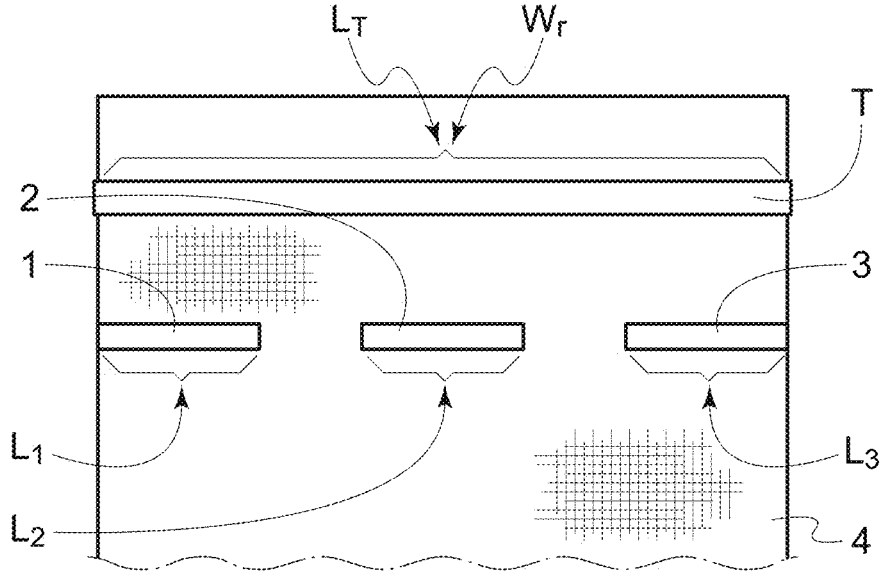
FIG. 1 is a top view of a traditional reel and of three reels according to the invention, which can replace the traditional reel.

With reference to FIG. 1, it is schematically shown a reel T that is a traditional reel having length $L_T$ suitable for being used with a fabric having width Wr. Reel T is a single piece reel that can extend from one side or edge of fabric 4, whereby the length of reel T is identical or substantially identical to width Wr of fabric 4. In FIG. 1, a reel system according to the invention is shown below reel T. The reel system shown in FIG. 1 has three reels, 1-3, each having a length $L_1$, $L_2$, $L_3$; as immediately visible, the sum of the lengths $L_1+L_2+L_3$ is less than the length $L_T$ of reel T and is also less that the width Wr of the fabric web 4 that is to be wound into a fabric roll having the three reel 1-3 at its center.

Figure 2:
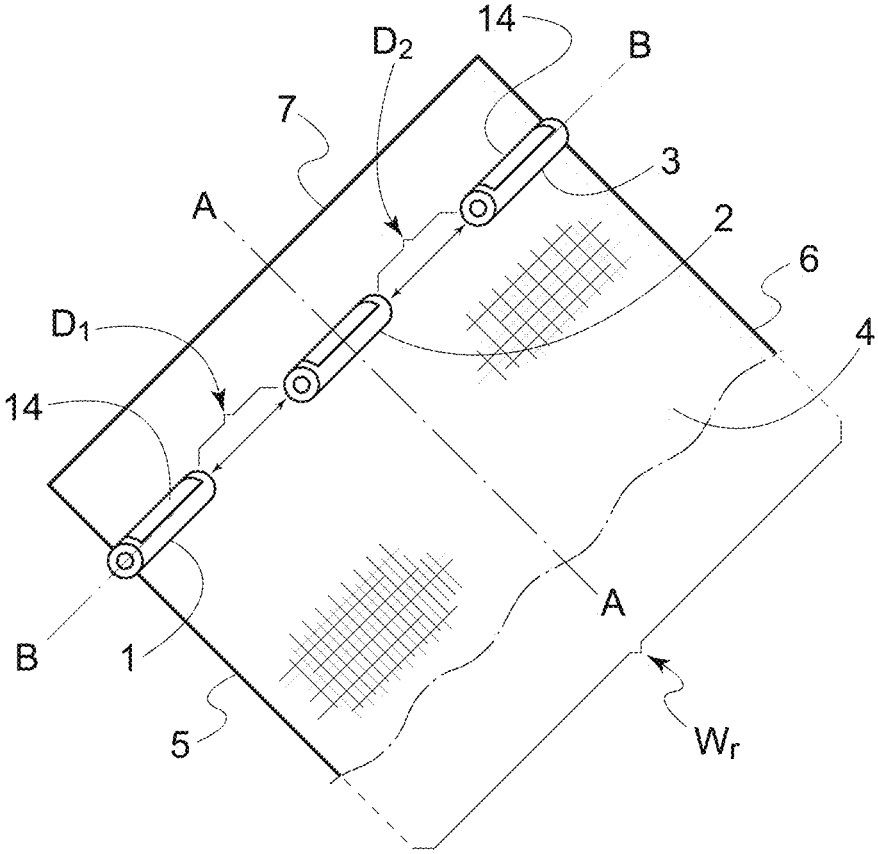
FIG. 2 is a prospective view of the three reels of FIG. 1 on a portion of fabric.
Figure 3:
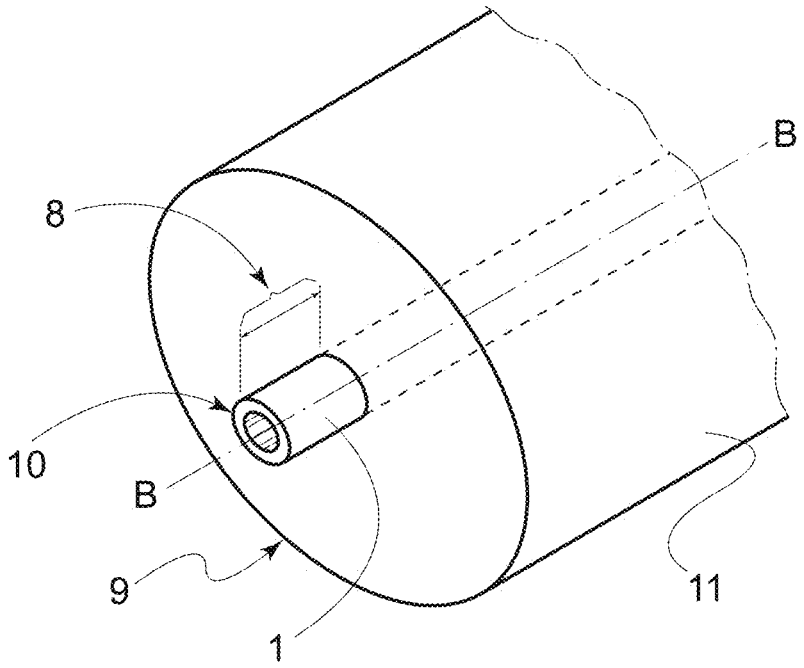
FIG. 3 is a partial perspective view of a fabric roll including an offset reel.

FIG. 2 schematically shows the reels 1-3 of FIG. 1 located on fabric 4, at the initial steps of the method of the invention. The reels 1-3 are positioned to have two external reels that are aligned or slightly offset with sides 5 and 6 of the fabric web 4, and a third reel 2 that is located centrally to the width of fabric 4. Preferably, the disposition of the reels with respect to the longitudinal axis A-A of the fabric, is symmetrical or substantially symmetrical to said axis. The reels are coaxial or substantially coaxially aligned along axis B-B of the roll 11 (FIGS. 2 and 3). The number of reels to be used depends on the width of the fabric. The invention provides for a minimum of two reels. In FIG. 2 the embodiment has three reels 1, 2 and 3, that are spaced from each other, i.e. two adjacent reels are spaced by a distance that is referred to as $D_1$ for reels 1-2 and $D_2$ for reels 2-3. The distance between two adjacent reels depends on the width Wr of the fabric and on the number n of reels and on their length $L_t$.

As above mentioned, a preferred embodiment of the method provides for a step in which the front edge 7 of the fabric web 4 is attached to the plurality of reels 1-3. This is done by manually winding the fabric's edge 7 around to reels or by attaching edge 7 of the fabric to reels 1-3; to this purpose, reels 1-3 are provided with suitable attachment means, preferably a strip of two-sided adhesive tape 14.

In the embodiment of FIG. 2, two reels, 1 and 3 are positioned at least at the ends of the roll width to support the edges of said fabric roll and avoid the fabric being without support at the edges of the roll, which can easily damage the fabric. It is however possible, as visible in FIG. 3, that the edge 10 of reels 1 and 3 is offset from the edge 9 of the roll 11 of fabric by a distance 8 that has a value up to about 10 cm. In other words, the edge, or extremity, 10 of the reel 1 may be spaced about 10 cm from the edge, or side, 9 of the fabric roll; the offset may be towards the outside, i.e. the reel protrudes from the roll as shown in FIG. 3, or towards inside the roll 11, i.e. the external edge 10 of reel 1 is housed inside the roll 11.

Figure 4:
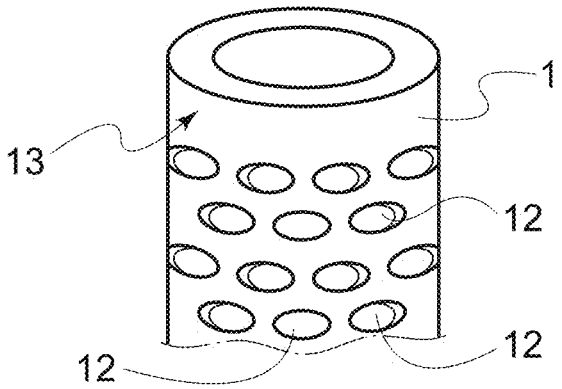
FIG. 4 is a perspective view of a reel having a porous structure.

Suitable materials for the reels are cardboard or similar materials of natural fibers such as cellulosic fibers, and man-made or synthetic materials such as PP, PE, PET, ABS, Rubber, PU etc. Light materials are preferred. To make the reel lighter, the surface of the reel can have a porous structure as shown in FIG. 4, i.e. a plurality of holes, or a plurality of areas (i.e. portions of the reel) having a reduced thickness with respect to the remaining parts of the reel, may be present on the reel. In the embodiment of FIG. 4 reel 1 is provided with a plurality of through holes 12. The total area of the holes, or the total area of the reduced thickness portions in the reel surface, may be in the range of 40% to 80% of the area of the external surface 13 of reel 1, preferably at least 60%. The ratio can be in the range between 0%-90%.

In a further embodiment, the method can comprise the use of an aligning shaft in order to assure optimal conditions and a coaxial alignment between the reels in order to facilitate the required positioning and spacing of the reels to be used for each fabric roll. The aligning shaft is provided with a cross section diameter that is lower than the internal diameter of the reels, so as to allow the shaft to be inserted in the reels. At least part of the external surface of the shaft is configured to expand radially to increase its external diameter and thus engage the internal surface of the reels to retain them in a required position. The shaft is preferably a pneumatic shaft wherein at least a portion of the surface or at least an element arranged on said surface can provide the requested radial expansion due to a feeding of pressurized air into the shaft.

Figure 5:
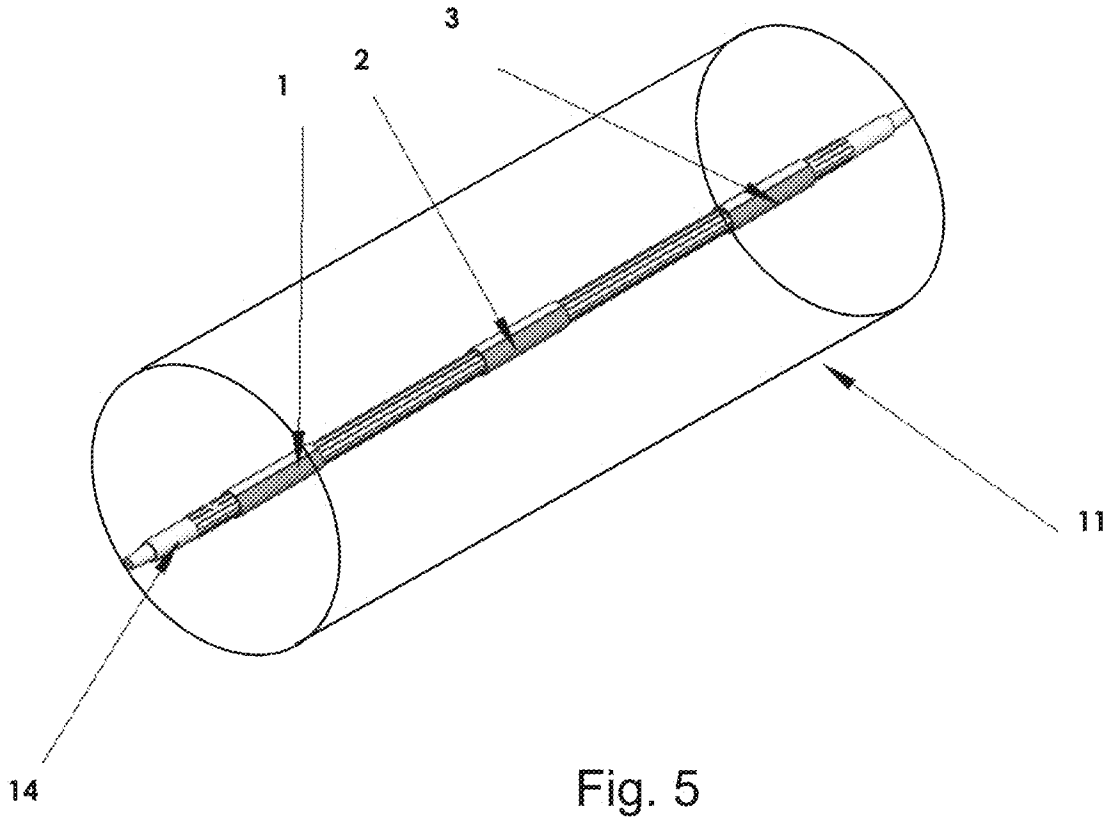
FIG. 5 to 7 are a schematic view of the steps of positioning the reels on a pneumatic aligning shaft.

As shown in FIG. 5, a pneumatic shaft 14 enables reels 1, 2 and 3 to be positioned coaxially spaced between each other as required and, referring specifically to the two outermost reels 1 and 3 (one at each end of the shaft 14), to position reel 1 and 3 at the two side edges of the fabric 11 as previously described.

Figure 6:
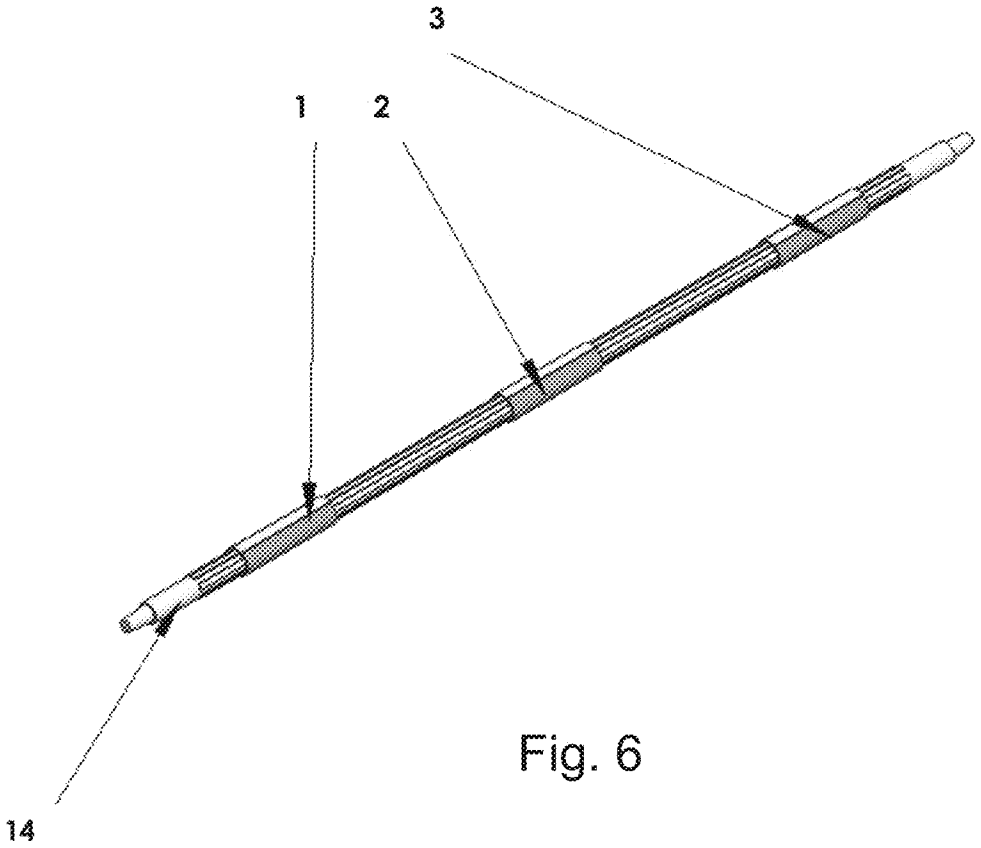
Figure 7:
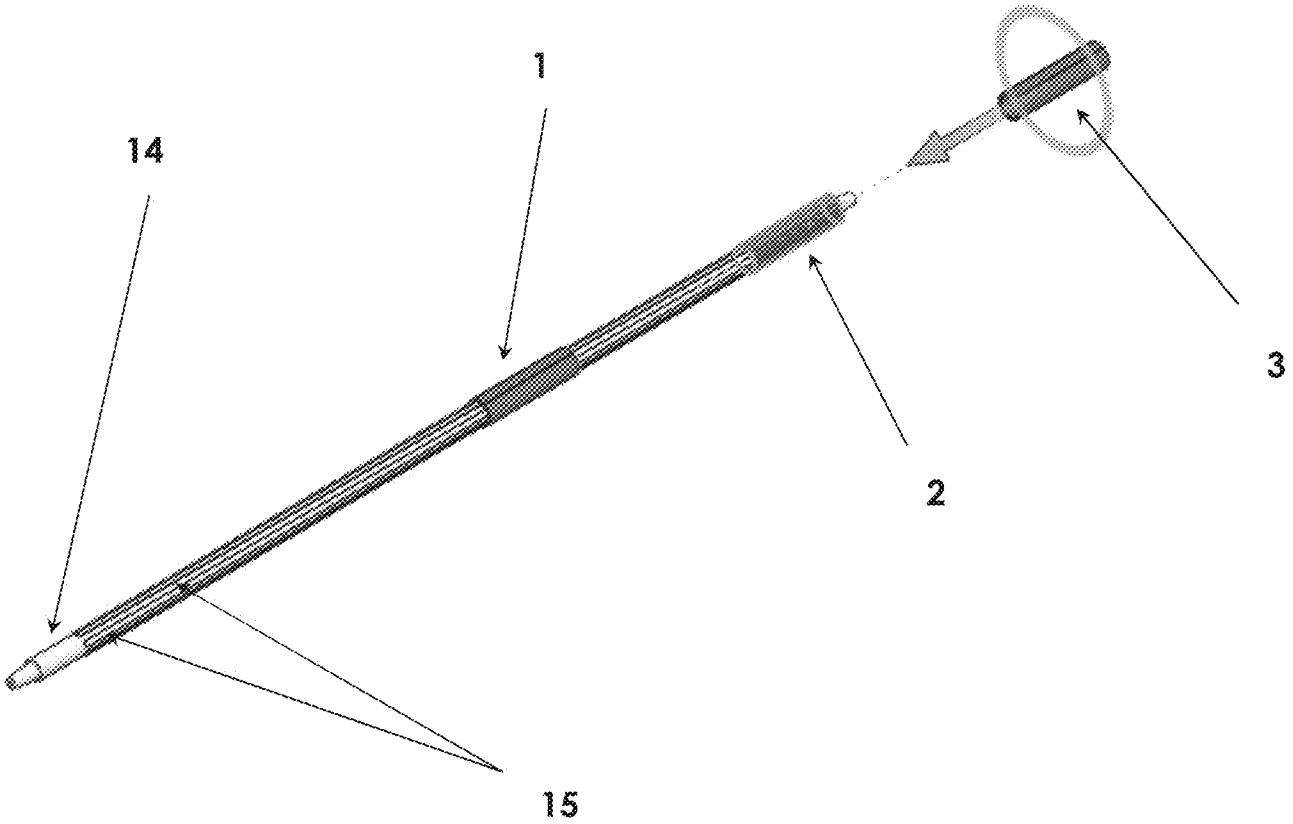

The shaft 14 has a tubular-like body with longitudinal elements or tabs on its circumferential outer surface, running lengthways parallel to its longitudinal axis (see FIG. 5 and FIG. 6). The pneumatic shaft 14 has an air-tight hollow core with its circumferential wall having means to allow the pneumatic shaft 14 to expand radially once air is fed under pressure inside its hollow core. Preferably, The method involving the use of a pneumatic shaft 14 thus implies the following steps for the mounting of reels 1-3:

positioning the reels in sequence along the pneumatic shaft 14 spaced as required (see FIG. 7);

pressurizing the pneumatic shaft 14 using air under pressure allowing radial expansion of the shaft, preferably through radial expansion of longitudinal elements 15 of the pneumatic shaft 14, thereby blocking in position the previously mounted reels 1-3. To this regard it should be noticed that any circumferential slippage between reels 1, 2 and 3 and shaft 14 is minimized through the circumferential contact between elements 15 of shaft 14 and reels 1-3. Similarly, longitudinal movement of reels 1-3 is prevented due to the rigidity of each reel core;

inserting the pneumatic shaft 14 in the winding module of the fabric winding machine ready for the process of fabric roll production.

The method has then a second phase involving the winding of the fabric 11 as per following steps:

starting the winding of fabric 11 and winding required length of fabric 11 on reels 1, 2 and 3 mounted on pneumatic shaft 14 with a velocity in the range of 5-25 meters/minute with a preferred value of approximately 10 meters/minute ending the winding operation and discharging air from inside the core of pneumatic shaft 14;

pulling out the pneumatic shaft 14 (which has regained its nominal diameter) from the core of roll fabric 11;

At the end of the process, the reels remain into the core of the fabric roll, i.e. they are retained in the position selected on the shaft, which actually is the position required for the reels with respect to the width of the fabric roll. The reels are coaxially aligned and are retained in this aligned and spaced position by the rigidity of the overall structure of the roll.

The invention claimed is:

1. A fabric roll (11), including at least two reels, and a fabric being wound around said reels, said reels being coaxially aligned and being spaced from each other, the at least two reels having a total length L that is less than the width (Wr) of said fabric roll, wherein the length Li of each of said reels is $L_1$, $L_2$, $L_n$ and the sum of the lengths of the reels ($\Sigma_{i=1}{}^{n}L_i$) is less than the width (Wr) of the fabric roll (11) ($\Sigma_{i=1}{}^{n}L_i$<Wr), and wherein the sum of the lengths of the reels ($\Sigma_{i=1}{}^{n}L_i$) is at least 13% of the width of the roll (Wr).

2. The fabric roll (11) according to claim 1, wherein said reels are positioned at least at the ends of the roll width to support both edges (9) of said fabric roll (11).

3. The fabric roll (11) according to claim 2, further including a reel that is centrally positioned with respect to the said width (Wr) of the fabric roll (11).

4. The fabric roll (11) according to claim 1, wherein the fabric (4) is characterized by an edge (7) and wherein the edge (7) of the fabric (4) in contact with said at least two reels, is tensioned over its width and attached to said at least two reels.

5. The fabric roll (11) according to claim 4, wherein said fabric (4) is attached to said reels by a two-sided adhesive tape (14).

6. A reel system for the fabric roll (11) according to claim 1, comprising a plurality of reels (L) for a single fabric roll (11).

* * * * *